US005962201A

United States Patent [19]

Ishikawa et al.

[11] Patent Number: 5,962,201

[45] **Date of Patent: *Oct. 5, 1999**

[54] METHOD OF PROCESSING A SILVER HALIDE PHOTOGRAPHIC MATERIAL

[75] Inventors: Wataru Ishikawa; Shoji Nishio, both of Hino, Japan

[73] Assignee: Konica Corporation, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/933,558

[22] Filed: Sep. 19, 1997

Related U.S. Application Data

[63] Continuation of application No. 08/700,969, Aug. 21, 1996, abandoned, which is a continuation of application No. 08/394,827, Feb. 27, 1995, abandoned.

[30] Foreign Application Priority Data

Mar. 8, 1994 [JP] Japan ..... 6-037231

[51] Int. Cl.[6] ..... G03C 5/29

[52] U.S. Cl. ..... 430/440; 430/446

[58] Field of Search ..... 430/440, 446, 430/480, 483, 488, 621

[56] References Cited

U.S. PATENT DOCUMENTS

| | | | |
|---|---|---|---|
| 5,217,842 | 6/1993 | Kojima et al. | 430/480 |
| 5,236,816 | 8/1993 | Purol et al. | 430/480 |
| 5,278,035 | 1/1994 | Knapp | 430/478 |
| 5,296,342 | 3/1994 | Roefs et al. | 430/440 |
| 5,318,881 | 6/1994 | Bucci et al. | 430/478 |
| 5,372,911 | 12/1994 | Obi et al. | 430/480 |
| 5,384,232 | 1/1995 | Bishop et al. | 430/446 |
| 5,508,153 | 4/1996 | Ishikawa et al. | 430/264 |

*Primary Examiner*—Hoa Van Le
*Attorney, Agent, or Firm*—Jordan B. Bierman; Bierman, Muserlian and Lucas

[57] ABSTRACT

A method of processing a silver halide photographic light-sensitive material by use of an automatic processor is disclosed, comprising the steps of developing an exposed photographic material with a developer, fixing with a fixer, washing and drying, wherein a swell ration of overall hydrophilic colloid layers including a silver halide emulsion layer and a protective layer provided on one side of a support is not more than 150%; and the developer, which contains substantially no dihydroxybenzene compound comprises a compound represented by the following formulas in combination with a 3-pyrazolidone compound or an aminophenol compound, and a carbonate salt in an amount of 0.35 mol/l or more.

18 Claims, No Drawings

METHOD OF PROCESSING A SILVER HALIDE PHOTOGRAPHIC MATERIAL

This application is a continuation of application Ser. No. 08/700,969 filed Aug. 21, 1996, now abandoned, which in turn is a continuation of Ser. No. 08/394,827filed Feb. 27, 1995 abandoned.

FIELD OF THE INVENTION

The present invention relates to a developer for a silver halide photographic light sensitive material and a processing method thereof, particularly a processing method of a silver halide photographic material with the use of an automatic processor, wherein a stable photographic performance can be achieved in rapid processing at a low developer-replenishing rate.

BACKGROUND OF THE INVENTION

Generally, processing of a silver halide photographic material with an automatic processor has resulted in improved processing stability, speed, simplicity and handling. In a developer for a black and white photographic light-sensitive material, there has been mainly used hydroquinone as a developing agent to achieve desirable levels of photographic activity, stability, availability, handling and cost thereof. However, hydroquinone is allergenic compound, unsuitable for human body. Therefore, there is a need for a developer containing no hydroquinone. U.S. Pat. No. 5,236,816, for example, discloses a developer containing ascorbic acid in place of hydroquinone.

Photographic processing effluent, which contains a harmful ingredient cannot disposed of in a public sewer. The effluent has been recovered for decomposition by a troublesome burning method at a high expense. Therefore, reduction of the amount of photographic effluent is desirable. As a means for solving these problems, there was proposed a reduction of the replenishing amount when the photographic material is processed by an automatic processor. Reduction of the replenishing amount resulted in accumulation of unnecessary reaction product formed during the course of processing in a processing tank. Specifically, silver salt dissolved out from a photographic material is precipitated on the surface of the photographic material to produce stain due to so-called silver sludge. In the field of printing, improved efficiency and speed-up of working, and shortening of processing time has been demanded. For the purpose of improvement in rapid-processability of photographic material, there was proposed reduction of the binder contained in the protective layer or an increase in the degree of swell of overall hydrophilic colloid layers including the emulsion layer. Reduction of the binder or an increase in the degree of swell, however, results in an increase of the silver complex dissolved out of the photographic material to cause silver sludge due to reduction thereof in the developer.

U.S. Pat. No 5,236,816 discloses an ascorbic acid developer in which a large amount of a carbonate salt is contained for the purpose of protecting the activity thereof agaist oxidation and preventing decomposition thereof. The use of the carbonate, however, was found to cause deterioration in silver sludge when rapid-processed at a low replenishing rate and therefore to be unfavorable for photographic quality.

Accordingly, there has been a strong demand for lowering the replenishing rate of an ascorbic acid-predeveloper and development of a processing chemical having excellent photographic quality.

SUMMARY OF THE INVENTION

Accordingly, a problems to be solved in the present invention is to provide a developer excellent in photographic quality and a processing method by use thereof when rapid-processed at a low replenishing rate with a ascorbic acid developer containing no hydroquinone.

The above problem can be solveved by a method of processing an exposed silver halide photographic light-sensitive material comprising a support having thereon hydrophilic colloid layers including a silver halide emulsion layer and provided thereon a protective layer by the use of an automatic processor, wherein a degree of swell of the hydrophilic colloid layers is not more than 150%; and the photographic material is developed with a developer containing substantially no dihydroxybenzene and containing a compound represented by formula [A], an auxiliary developing agent displaying superadditivity in combination with the hydroquinone and a carbonate salt, as a buffer, of not less than 0.35 mol/liter.

formula [A]

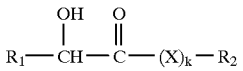

wherein $R_1$ and $R_2$ independently represent an alkyl group, an amino group, an alkoxy group and an alkylthio group, each of which may be substituted, and $R_1$ and $R_2$ may combine to form a ring;k is 0 or 1; and X is —CO— or —CS—.

As preferred embodiments of the invention, the developer is replenished a a rate of not more than 300 ml per $m^2$ of the photographic material, a line-speed of an automatic processing machine is not less than 1500 mm/min., and a total processing time from a time when a photographic material is dipped in the developer to a time when drying is completed is within 45 seconds.

DETAILED DESCRIPTION OF THE INVENTION

In the afore-mentioned formula [A], a compound represented by the following formula [A-a] is preferable.

formula [A-a]

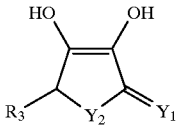

wherein $R_3$ represents a hydrogen atom, an alkyl group, aryl group, amino group or an alkoxy group, which may be substituted, a sulfo group, a carboxy group, an amide group, a sulfonamide group; $Y_1$ represents O or S; Y2 represents O, S or $NR_4$, in which $R_4$ a substituted or unsubstituted alkyl or aryl group.

In formulas [A] and [A-a], an alkyl group is preferably a lower alkyl having 1 to 5 carbon atoms; as an amino group, is preferable an unsubstituted amino group or a amino substituted by a lower alkyl group; as an alkoxy group, is preferable a lower alkoxy group; as an aryl group, is preferable phenyl or naphthyl, each of which may be substituted by hydroxy, a halogen atom, a sulfo group, a carboxy group, am amide or an suofonamide group.

Compounds represented by formular [A] or [A-a] are exemplified as bellows, but the present invention is not limited thereto.

Examples of formula [A]

| Compound No. | X | | $R_1$ | $R_2$ |
|---|---|---|---|---|
| A-1 | — | (k = 0) | $HOCH_2CH(OH)-CH(OH)-$ | —OH |
| A-2 | — | (k = 0) | $CH_3CH(OH)-CH(OH)-$ | —OH |
| A-3 | — | (k = 0) | $HOCH_2CH(OH)-CH(OH)-$ | $-CH_3$ |
| A-4 | — | (k = 0) | $CH_3CH(OH)-CH(OH)-$ | $-CH_3$ |
| A-5 | $-C(=O)-$ | (k = 1) | $HOCH_2CH(OH)-CH(OH)-$ | —OH |
| A-6 | $-C(=O)-$ | (k = 1) | $CH_3CH(OH)-CH(OH)-$ | —OH |
| A-7 | $-C(=S)-$ | (k = 1) | $HOCH_2CH(OH)-CH(OH)-$ | —OH |
| A-8 | $-C(=S)-$ | (k = 1) | $CH_3CH(OH)-CH(OH)-$ | —OH |
| A-9 | $-C(=O)-$ | (k = 1) | $HO-CH_2-$ | —OH |
| A-10 | $-C(=O)-$ | (k = 1) | $HO-CH_2-$ | $-CH_2$ |
| A-11 | $-C(=O)-$ | (k = 1) | $HO-CH_2-$ | $-C_2H_5$ |
| A-12 | $-C(=O)-$ | (k = 1) | $HO-CH_2-$ | $-C_2H_4OH$ |

Examples of formula [A-a]

| Compound No. | $Y_1$ | $Y_2$ | $R_3$ | Compound No. | $Y_1$ | $Y_2$ | $R_3$ |
|---|---|---|---|---|---|---|---|
| A-13 | 0 | 0 | H | A-22 | S | 0 | $HOCH_2CH(OH)-$ |
| A-14 | 0 | 0 | $CH_3$ | A-23 | 0 | N | H |
| A-15 | 0 | 0 | $CH_2(OH)$ | A-24 | 0 | N | $HOCH_2CH(OH)-$ |
| A-16 | 0 | 0 | $CH_3CH(OH)-$ | A-25 | 0 | S | H |

-continued

| Compound No. | $Y_1$ | $Y_2$ | $R_3$ | Compound No. | $Y_1$ | $Y_2$ | $R_3$ |
|---|---|---|---|---|---|---|---|
| A-17 | 0 | 0 | $HOCH_2CH(OH)$— | A-26 | 0 | S | $HOCH_2CH(OH)$— |
| A-18 | 0 | 0 | $ClCH_2CH(OH)$— | A-27 | 0 | S | $CH_3CH(OH)$— |
| A-19 | 0 | 0 | $HOOCCH_2CH(OH)$— | A-28 | S | S | H |
| A-20 | S | 0 | H | A-29 | S | S | $HOCH_2CH(OH)$— |
| A-21 | S | 0 | $CH_3CH(OH)$— | A-30 | S | S | H |

A compound represented by formula [A] or [A-a] is containd in an amount of 0.05 to 5, preferably 0.1 to 1.0 mol per liter of a developer. These compounds, which are typical ones derived from an ascorbic acid or isoascorbic acid are commercially available and can be easily synthesyzed in a well known method.

As an auxiliary developing agent displaying supperadditivity in combination with a compound represent by formula [A], are cited 3-pyrazolidone derivative and p-aminophenol derivative. These compounds have been known as a auxiliary developing agent. The following compounds are exemplified, which are not limited thereto.

1-Phenyl-3-pyrazolidone

1-Phenyl-4,4-dimethyl-3-pyrazolidone 1-phenyl-4-methyl-4-hydroxymethyl-3-pyrazolidone 1-pheny-5-methyl-3-pyrazolidone 1-p-Aminophenyl-4,4-dimethyl-3-pyrazolidone 1-p-Tolyl-4,4-dimethyl 3-pyrazolidone 1-p-Tolyl-4-methyl-4-hydroxymethyl-3-pyrazolidone N-Methyl-p-aminophenol N-(β-Hydroxyethyl)-p-aminophenol N-(4-Hydroxyphenylglycine 2-Methyl-p-aminophenol p-Benzylaminophenol The auxiliary developing agent is contained in an amount of 0.001 to 0.05, preferably, 0.0035 to 0.035, more preferably, 0.005 to 0.01 mol per liter of a developer. Among compounds as above-described, a 3-pyrazolidone compound is preferable.

A developer of the invention does not substantilly contain a dihydroxybenzene developing agent. The dihydroxybenzene developing agent as herein described is a compound represented by the following formulas [V-1] to [V-3].

formula [V-1]

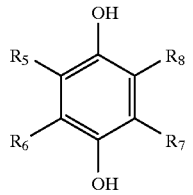

formula [V-2]

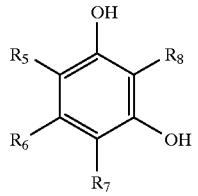

formula [V-3]

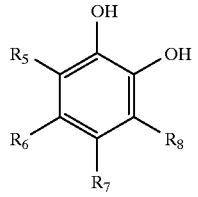

wherein $R_5$, $R_6$, $R_7$ and $R_8$ independently represent a hydrogen atom, an alkyl group, an aryl group, a carboxy group, a halogen atom or a sulfo group.

As examples thereof, are cited hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone and 2,5-dimethylhydroquinone. Among them, hydroquinone is representative one.

In the invention, any dihydroxybenzene(s) is not substantially contained. The word 'not substantilly contained" means that dihydroxybenzene is not absolutely contained or it is contained in a slight amount not so as to display a developing effect. Thus, dihydroxybenzene is contained in an amount of not more than 5 mol % of a compound of formula [A] or not more than 0.03 mol/liter. More preferably, no dihydroxybenzene is contained In the present invention, a carbonate salt, as a buffer agentis contained in a developer. As examples of carbontes, are cited sodium carbonate, potassium carbonate, lithium carbonate and ammonium carbonate; preferably, sodium carbonate and potassium carbonate. The carbonate is contained in an amount of 0.35 mol/l or more; preferably, 0.5 to 1.5 mol/l; more preferably, 0.8 to 1.3 mol/l.

In a silver halide photographic material of the invention, the degree of swell (alternatively, swell ratio) of hydrophilic colloid layers including a silver halide emulsion layer and a protective layer provided on one-side of a support is not more than 150%, preferably 70 to 150%. When the degree of swell exceeds 150%, a silver complex is increasingly disolved out into a developer to cause an increase of silver-sludge. When the degree of swell is less than 70%, dissolving-out of a silver complex is decreased and silver stain may get better, however, developing and fixing speeds are retarded to affect adversely photographic performance. The degree of swell of the hydrophilic colloid layers in the invention can be determined according to the equation defined as follows.

$$\text{Degree of swell } (\%)=(d-d_0)\div d_0\times 100$$

wherein $d_0$ is a total thickness of hydrophilic colloid layers and d is a thickness of the hydrophilic colloid layers after it is dipped in a distilled water at 25° C. over a period of one minute. The thickness is measured in a manner similar to a electric micrometer as described in JIS B 7536, such as electro-micrometer produced by Adachi Electric Co., Ltd. (Type K306).

As a method for controling optimally the degree of swell of the hydrophilic colloid layers incuding a silver halide emulsion and a protective layer is cited the use of an inorganic or organic gelatin hardener. For example, an active vinyl compound such as 1,3,5-triacryloyl-hexahydro-s-triazine, bis(vinylsuofonyl)methyl ether or N,N'-methylenebis-[β-(vinylsulfony)propyoneamide; a active halogen compound such as 2,4-dichloro-6-hydroxy-s-triazine; mucohalogenic acid such as mucochloric acid; N-carbamoylpyridinium salt such as (1-morphorinocarbonyl-3-pyridinio)methanesulfonate; or a haloamidinium salt such as 1-(1chloro-1pyridinomethylene) pyrilidinium or 2-naphthalene sulfonate is used singly or in combination thereof. Among them, a active vinyl compound as described in JP-A 53-41220, 53-57257, 59-162546 and 60-80846, and an active halogen compound as described in U.S. Pat. No 3,325,287. are preferable.

In a black and white photographic material of the invention, it is preferable that at least one conductive layer is provided on a support. As a representative method for forming a conductive layer, is to form the conductive layer by use of a water-soluble conductive polymer, a hydrophobic polymer and a hardener or by use of a metal oxide, as described in JP-A 3-265842 at pages 5–15.

In a silver halide emulsion of the invention, there can be employed any of silver halides such as silver bromide, silver iodobromide, silver iodochloride, silver iodochlorobromide, silver chlorobromide and silver chloride. Preferable is silver bromochloride or silver iodobromochloride, each of which contains 50 mol % or more chloride, or silver chloride.

In the invention, is preferable monodispersed silver halide grains having a variation coefficient of not more than 15%. The variation coefficient is defined as (standard deviation of grain-size distribution)/(average grain-size)×100(%).

In a silver halide emulsion of the invention, various technique and additives can be used. In a silver halide emulsion and a backing layer used in the invention, for example, is contained a chemical sensitizer, toning agent, hardening agent, surfactant, thickening agent, plasticizer, sliding agent, development retarder, UV absorbent, anti-irradiation dye, heavy metal, matting agent or polymer latex.

These additives are described more in detail in Research Disclosure Vol. 176, Item 7643 (December, 1978); ibid., Vol. 187, Item 8716 (November, 1979). Corresponding sections are as follows.

| Additives | RD/7643 (page) | RD/8716 (page) |
|---|---|---|
| 1. Chemical sensitizer | 23 | 648 right |
| 2. Sensitivity-increasing agent | | ditto |
| 3. Spectral sensitizer and supersensitizer | 23–24 | ditto<br>649 right |
| 4. Whitening agent | 24 | |
| 5. Fog inhibitor, stabilizer | 24–25 | 649 right |
| 6. Light absorbent, filter dye UV absorbent | 25–26 | 649 right-<br>650 left |
| 7. Antistain agent | 25 right | 650 left-right |
| 8. Image-dye stabilizer | 25 | |
| 9. Hardening agent | 26 | 651 left |
| 10. Binder | 26 | ditto |
| 11. Plasticizer, Lubricant | 27 | 650 right |
| 12. Coating aid, Surfactant | 26–27 | ditto |
| 13. Antistatic agent | 27 | ditto |

Materials usable as a support for the silver halide photographic material of the invention include cellulose acetate, cellulose nitrate, polyester such as polyethyleneterephthalate, polyolefin such as polyethylene, polystylene, a baryta paper, polyolefin-coated paper, glass and metal. The support may be subbed, if necessary.

EXAMPLES

Embodiments of the present invention will be described concretely, however, the invention is not limitted thereto.

Preparation of a support having a conductive layer:

Subbed polyethyleneterephthalate base film having a thickness of 100 μm was subjected to corona discharge in an amount of 8 W/m$^2$, min. and further thereon the following anti-static solution was coated by means of a roll-fit coating pan and an air-knife at a rate of 70 m/min. so as to be coating weights as follows.

| | |
|---|---|
| Water-soluble conductive polymer P | 0.6 g/m$^2$ |
| Hydrophobic polymer particles L | 0.4 g/m$^2$ |
| Polyethylene compound $A_0$ | 0.06 g/m$^2$ |
| Hardener E | 0.2 g/m$^2$ |

Thus-coated material was dried at 90° C. over a period of 2 minutes and thereafter, was subjected to heat treatment at 140° C. for 90 seconds.

Polymer P

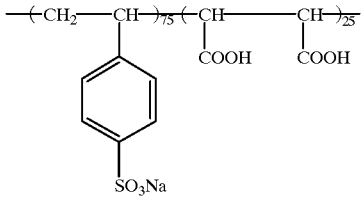

Mn = 500

Polymer particles L

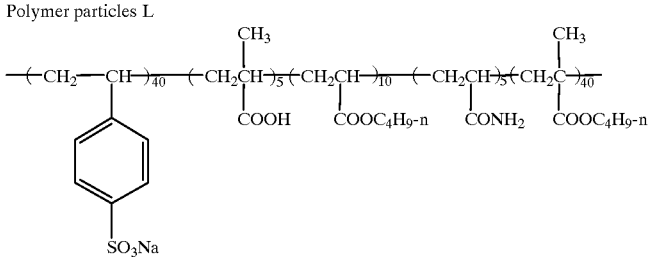

Compound $A_0$ $HO(CH_2CH_2O)_{15}H$

Hardener E

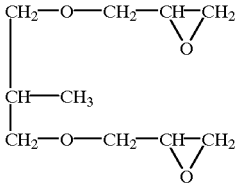

Preparation of a silver halide emulsion:

A silver iodobromochloride emulsion containing 2 mol % iodide was prepared in a double jet precipitation method. During the course of precipitation, $K_2IrCl_6$ was added in an amount of $8\times10^{-7}$ mol per mol of silver. The resulting emulsion was comprised of monodispersed cubic crystal grains having an average size of 0.20 $\mu$m and a variation coefficient of 9%. The emulsion was washed according to a conventional procedure and the emulsion had a pAg of 8.0 at 40° C. Subsequently, spectral sensitizing dye D-1 was added to the emulsion in an amount of 150 mg/mol Ag and then a mixture of compounds [A], [B] and [C] were added. Further, the emulsion was subjected to sulfur sensitization.

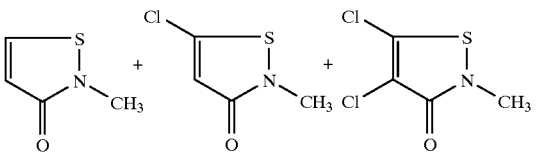

[A] + [B] + [C]

Sensitizing dye D-1

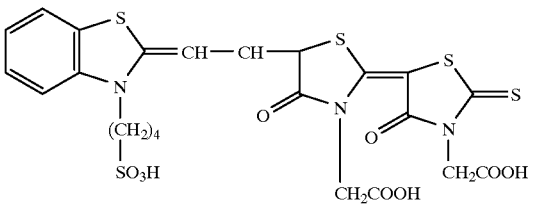

(1) Composition of a light sensitive silver halide emulsion

| | |
|---|---|
| Gelatin | 1.2 g/m$^2$ |
| Silver halide emulsion A (silver weight) | 3.2 g/m$^2$ |
| Stabilizer: 4-methyl-6-hydroxy-1,3,3a,7-tetrazaindene | 30 mg/m$^2$ |
| Fog inhibitor: 5-nitroindazole | 10 mg/m$^2$ |
| 1-phenyl-5-mercaptotetrazole | 5 mg/m$^2$ |
| Surfactant: sodium dodecylbenzenesulfonate | 0.1 g/m$^2$ |
| Surfactant: S-1 | 8 mg/m$^2$ |

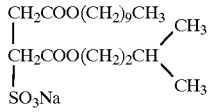

| | |
|---|---|
| Hydrazine derivative | 7 × 10$^{-5}$ mol/m$^2$ |

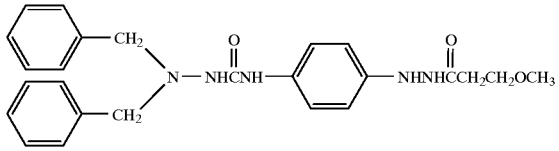

| | |
|---|---|
| Nucleation-promoting agent | 3 × 10$^{-5}$ mol/m$^2$ |

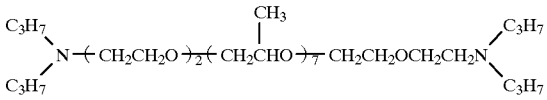

| | |
|---|---|
| Latex polymer: | 1 g/m$^2$ |

-continued

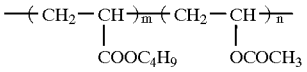

m:n = 50:50

Polyethyleneglycol (molecular weight 4000) 0.1/m$^2$

Hardener HA-1

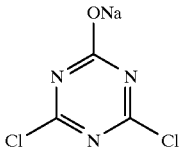

(2) Composition of protective layer

| | |
|---|---|
| Gelatin | an amount as shown in Table 1 |
| Surfactant: S-2 | 10 mg/m$^2$ |

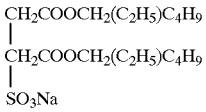

| | |
|---|---|
| Surfactant: S-3 | 10 mg/m$^2$ |

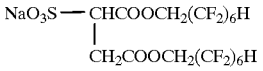

| | |
|---|---|
| Matting agent: monodispersed silica particles having an avrage size of 3.5 $\mu$m | 3 mg/m$^2$ |

(3) Composition of backing layer (a) 30 mg/m$^2$

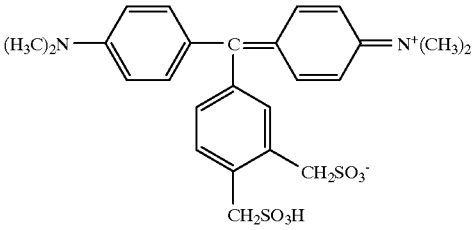

(b) 75 mg/m$^2$

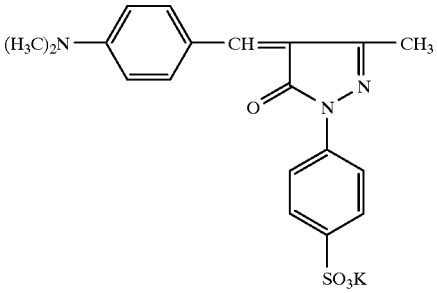

-continued (c) 30 mg/m$^2$

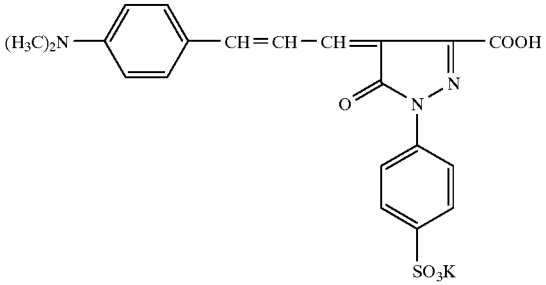

| | |
|---|---|
| Gelatin | 2.4 g/m$^2$ |
| Surfactant: sodium dodecylbenzenesulfonate: | 0.1 g/m$^2$ |
| S-1 | 6 mg/m$^2$ |
| Colloidal silica | 100 mg/m$_2$ |
| Hardener: E | 55 mg/m$^2$ |

(4) Composition of backing protective layer

| | |
|---|---|
| Gelatin | 1 g/m$^2$ |
| Matting agent: monodispersed particles of polymethylmethaacrylate (av. size, 5.0 $\mu$m) | 50 mg/m$^2$ |
| Surfactant: S-2 | 10 mg/m$^2$ |
| Hardener: glyoxal | 25 mg/m$^2$ |
| : H-1 | 35 mg/m$^2$ |

(5) Composition of hydrophilic colloid layer 1

| | |
|---|---|
| Gelatin | 0.5 g/m$^2$ |
| Surfactant: S-1 | 9 mg/m$^2$ |

(6) Composition of hydrophilic colloid layer 2

| | |
|---|---|
| Gelatin | 1.0 g/m$^2$ |
| Silver halide emulsion A | 0.3 g/m$^2$ |
| Stabilizer: 4-methyl-6-hydroxy-1,3,3a,7-tetrazaindene | 30 mg/m$^2$ |
| Fog inhibitor: 5-nitroindazole | 10 mg/m$^2$ |
| 1-phenyl-5-mercaptotetrazole | 5 mg/m$^2$ |
| Surfactant: S-1 | 8 mg/m$^2$ |
| Redox compound | 3 × 10$^{-5}$ mol/m$^2$ |

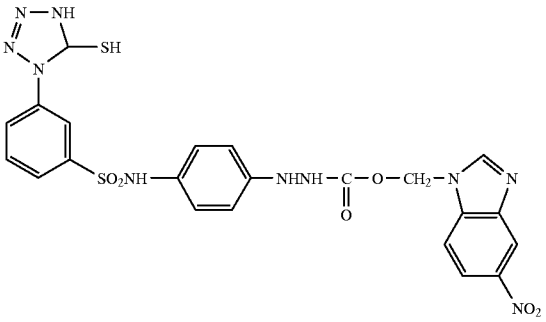

On the side opposite to the conductive layer of the support, was coated the following layers in this order.

1st layer: Silver halide emulsion layer of Composition (1)

2nd layer: Hydrophilic colloid layer 1 of Composition (5)

3rd layer: Hydrophilic colloid layer 2 of Composition (6)

4th layer: Protective layer of composition (2)

On the conductive layer-side, a backing layer of Composition (3) and a backing protective layer of Composition (4) were coated in this order. An addition amount of a hardener, 1,3-vinylsulfonyl-2-propunol into an emulsion protective layer was adjusted so as to have a degree of swell in samples 1 to 5 as follows.

Sample 1: 190%, Sample 2: 140%, Sample 3: 130%, Sample 4: 100%, Sample 5: 60%.

Composition of developer:

| | |
|---|---|
| Isoascorbic acid | 0.2 mol/l |
| Sodium sulfite | 0.14 mol/l |
| Dimezon (1-phenyl-4-hydroxymethyl-4-methyl-3-pyrazolidone) | 2.3 g/l |
| potassium carbonate | 0.8 mol/l |
| 5-Methylbenzotriazole | 0.25 g/l |
| Potassium bromide | 6.0 g/l |
| 8-mercaptoadenine | 50 mg/l |

Using the above developer and a fixer (CFL-871, product of Konica), samples as described above were running-processed with an automatic processor GR-26SR (product of Konica), wherein 700 pieces of full-sized photographic samples (610×508 $mm^2$) were processed.

After running-processing, three pieces of wholly developed full-size samples were processed and visually evaluated with respect to silver sludge, when taken out from the processor. Evaluation was performed, based on the following five grades of from 5 (the best-level without stain) to 1 (the worst-level).

Photographic performance was evaluated with respect to a sensitivity at a density of 2.5 at the completion of running-processing. The sensitivity was shown as a relative value based on the sensitivity at the start of running-processing being 100. Gradation (γ-value) was defined as a a slope of a line that connects two points corresponding to densities of 0.1 and 2.5 on a characteristic curve. A γ-value of 6 or less is unsuitable for use and that of 6 to 9.5 is insuficient for use. A γ-value of 9.5 or more gives rise to a ultra-high contrast image suitable for use as a graphic arts photographic material.

Processing condition:

| Step | Temperature | Time | Replenishing rate($ml/m^2$) |
|---|---|---|---|
| Developing | 35° C. | 30 sec. | 250 |
| Fixing | 35° C. | 20 sec. | 250 |
| Washing | ord.temp. | 20 sec. | — |
| Drying | 40° C. | 20 sec. | — |

TABLE 1

| Sample No. | Swell ratio (%) | Sensitivity | γ-value | Silver sludge | Remarks |
|---|---|---|---|---|---|
| 1 | 190 | 98 | 14.3 | 2 | Comp. |
| 2 | 140 | 93 | 13.8 | 4 | Inv. |
| 3 | 120 | 88 | 13.2 | 5 | Inv. |
| 4 | 100 | 87 | 13.0 | 5 | Inv. |
| 5 | 60 | 62 | 8.5 | 5 | Inv. |

As can be seen from the table, inventive samples provided little fluctuation in photographic performance between at the initial time and the finish time in running-processing and silver sludge was low and practical use level.

Example 2

Photographic samples Nos. 1 through 5 were running-processed in the same manner as in Example 1, except that the replenishing rate of the developer was changed. Results thereof shown in Table 2.

TABLE 2

| Sample No. | Swell ratio (%) | Developer replenishing rate ($ml/m^2$) 350 (Comp.) (a) | (b) | (c) | 250 (Inv.) (a) | (b) | (c) | 150 (Inv.) (a) | (b) | (c) | Remarks |
|---|---|---|---|---|---|---|---|---|---|---|---|
| 1 | 190 | 99 | 14.4 | 2 | 98 | 14.3 | 2 | 85 | 13.2 | 1 | Comp. |
| 2 | 140 | 96 | 13.9 | 5 | 93 | 13.8 | 4 | 80 | 42.1 | 4 | Inv. |
| 3 | 120 | 92 | 13.5 | 5 | 88 | 13.2 | 5 | 77 | 11.8 | 4 | Inv. |
| 4 | 100 | 90 | 13.3 | 5 | 87 | 13.0 | 5 | 75 | 11.5 | 5 | Inv. |
| 5 | 60 | 69 | 8.9 | 5 | 62 | 8.5 | 5 | 42 | 6.3 | 5 | Inv. |

(a) Sensitivity
(b) γ-value
(c) Silver sludge

As can be seen from the table, inventive samples led to improved results in silver sludge even when processed at a reduced replenishing rate.

Example 3

Samples Nos 1 through 5 were running-processed in the same manner as in Example 1, except that the processing speed was changed as shown in table 3. Results thereof were shown in table 3.

TABLE 3

| Sample No. | Swell ratio (%) | Processing speed (mm/min) 986 (a) | (b) | (c) | 1730 (a) | (b) | (c) | 2385 (a) | (b) | (c) | Remarks |
|---|---|---|---|---|---|---|---|---|---|---|---|
| 1 | 190 | 98 | 14.3 | 2 | 83 | 14.0 | 1 | 78 | 13.7 | 1 | Comp. |
| 2 | 140 | 93 | 13.8 | 4 | 80 | 13.5 | 4 | 75 | 13.0 | 4 | Inv. |
| 3 | 120 | 88 | 13.2 | 5 | 77 | 12.8 | 4 | 73 | 12.6 | 4 | Inv. |
| 4 | 100 | 87 | 13.0 | 5 | 75 | 12.7 | 5 | 70 | 12.0 | 4 | Inv. |
| 5 | 60 | 62 | 8.5 | 5 | 47 | 8.0 | 5 | 38 | 7.6 | 5 | Inv. |

(a) Sensitivity
(b) γ-value
(c) Silver sludge

As can be seen from the table, inventive samples led to improved results in silver sludge even when rapid-processed.

What is claimed is:

1. A method of processing a black and white silver halide photographic light-sensitive material and reducing silver sludge staining, said photographic material comprising a support having on one side thereof hydrophilic colloid layers including a silver halide emulsion layer and a protective layer, by use of an automatic processor comprising developing an exposed photographic material with a developer, fixing with a fixer, washing and drying, wherein:

(a) the hydrophilic colloid layers have a degree of swell of not more than 150%, said degree of swell being determined as follows:

$$\text{Degree of swell } (\%)=(d-d_0)\div d_0\times 100$$

wherein $d_0$ is a total thickness of hydrophilic colloid layers and d is a thickness of the hydrophilic colloid layers after having been dipped in distilled water at 25° C. over a period of one minute;

(b) said developer contains a compound represented by formula [A-a] in combination with a 3-pyrazolidone compound or an aminophenol compound, said developer further containing a carbonate salt in an amount of 0.35 mol/1 or more and being substantially free from dihydroxybenzene compounds, formula [A-a]

formula [A-a]

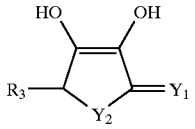

wherein $R_3$ represents a hydrogen atom, an alkyl, aryl, amino or alkoxy group, each of which may be substituted, a sulfo group, a carboxy group, an amide group, or a sulfonamide group; $Y_1$ represents a sulfur or oxygen atom; $Y_2$ represents a sulfur or oxygen atom, or $NR_4$, in which $R_4$ represents an alkyl or aryl group, each of which may be substituted; and (c) said developer is replenished by a developer-replenisher wherein said developer-replenisher is replenished at a rate of not more than 300 ml per $m^2$ of a photographic material.

2. The method of claim 1, wherein said 3-pyrazolidone compound or aminophenol compound is 1-phenyl-3-pyrazolidone, 1-phenyl-4,4-dimethyl-3-pyrazolidone, 1-phenyl-4-methyl-4-hydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, 1-p-tolyl-4-methyl-4-hydroxymethyl-3-pyrazolidone, n-methyl-p-aminophenol, n-(β-hydroxyethyl)-p-aminophenol, N-(4-hydroxyphenyl) glycine, 2-methyl-p-aminophenol, p-benzylaminophenol.

3. The method of claim 1, wherein said silver halide emulsion layer contains silver halide grains comprising silver chloride, silver bromochloride, silver iodochloride, silver iodobromochloride, silver bromide or silver iodobromide.

4. The method of claim 3, wherein said silver halide grains comprise silver chloride, silver bromochloride or silver iodobromochloride.

5. The method of claim 1, wherein said photographic material is processed over a period of time of 45 seconds or less in total.

6. The method of claim 4 wherein said silver bromochloride or silver iodobromochloride contains 50 mol % or more chloride.

7. The method of claim 1 wherein the hydrophilic colloid layers on said light-sensitive material have a degree of swell of 70% to 150%.

8. The method of claim 1 wherein said compound represented by formula [A-a] is a compound selected from the group consisting of the compounds represented by formula A-14 through A-18:

A-14

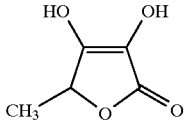

-continued

A-15

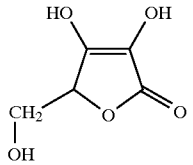

A-16

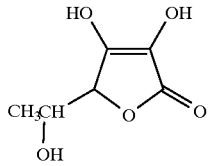

A-17

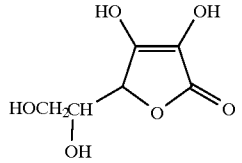

A-18

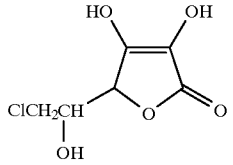

9. The method of claim 1 wherein said compound represented by formula [A-a] is isoascorbic acid.

10. A method for processing a black and white silver halide photographic light-sensitive material using an automatic processor wherein the light-sensitive material comprises a support having on one side thereof hydrophilic colloidal layers which include a silver halide emulsion layer and a protective layer and wherein the automatic processor subjects the photographic material to developing with a developer solution, fixing with a fixer, and washing and drying, the improvement wherein:

(a) said hydrophilic colloidal layers on said light-sensitive material has a degree of swell of not more than 150%, said degree of swell being determined as follows:

$$\text{Degree of swell } (\%)=(d-d_0)\div d_0\times 100$$

wherein $d_0$ is a total thickness of hydrophilic colloid layers and d is a thickness of the hydrophilic colloid layers after having been dipped in distilled water at 25° C. over a period of one minute;

(b) said developer solution comprises (b1) an absorbic acid-like compound represented by formula [A-a]

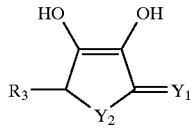

wherein $R_3$ represents a hydrogen atom, an alkyl, aryl, amino or alkoxy group, each of which may be substituted, a sulfo group, a carboxy group, an amide group, or a sulfonamide group; $Y_1$ represents a sulfur or oxygen atom; $Y_2$ represents a sulfur or oxygen atom, or $NR_4$, in which $R_4$ represents an alkyl or aryl group, each of which may be substituted;

(b2) an auxiliary developing agent which is either a 3-pyrazolidone compound or an aminophenol compound;

(b3) a carbonate salt in an amount of 0.35 mol/l or more; and (b4) substantially no dihydroxybenzene compound; and (c) said developer is replenished by a developer-replenisher wherein said developer-replenisher is replenished at a rate of not more than 300 ml per $m^2$ of a photographic material.

11. The method of claim 10, wherein said 3-pyrazolidone compound or aminophenol compound is 1-phenyl-3-pyrazolidone, 1-phenyl-4,4-dimethyl-3-pyrazolidone, 1-phenyl-4-methyl-4-hydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, 1-p-tolyl-4-methyl-4-hydroxymethyl-3-pyrazolidone, n-methyl1-p-aminophenol, n-(β-hydroxyethyl)-p-aminophenol, N-(4-hydroxyphenyl) glycine, 2-methyl-p-aminophenol, p-benzylaminophenol.

12. The method of claim 10, wherein said silver halide emulsion layer contains silver halide grains comprising silver chloride, silver bromochloride, silver iodochloride, silver iodobromochloride, silver bromide or silver iodobromide.

13. The method of claim 10, wherein said silver halide grains comprise silver chloride, silver bromochloride or silver iodobromochloride.

14. The method of claim 10, wherein said photographic material is processed over a period of time of 45 seconds or less in total.

15. The method of claim 13, wherein said silver bromochloride or silver iodobromochloride contains 50 mol % or more chloride.

16. The method of claim 10 wherein the hydrophilic colloidal layers on said light-sensitive material have a degree of swell of 70% to 150%.

17. The method of claim 10 wherein said compound represented by formula [A-a] is a compound selected from the group consisting of the compounds represented by the following formula A-14 through A-18:

A-14

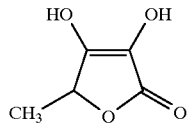

A-15

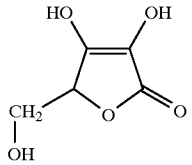

A-16

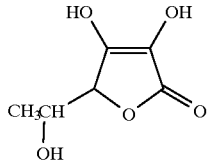

A-17

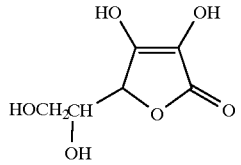

A-18

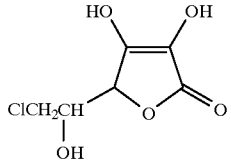

18. The method of claim 10 wherein said compound represented by formula [A-a] is isoascorbic acid.

* * * * *